US010925122B2

(12) United States Patent
Anton Falcon et al.

(10) Patent No.: US 10,925,122 B2
(45) Date of Patent: Feb. 16, 2021

(54) COOK TOP COMPRISING AT LEAST TWO HEATING ELEMENTS AND A POWER ELECTRONICS ARRANGEMENT

(75) Inventors: Daniel Anton Falcon, Saragossa (ES); Jose Ignacio Artigas Maestre, Saragossa (ES); Luis Angel Barragan Perez, Saragossa (ES); Carlos Bernal Ruiz, La Puebla de Alfinden (ES); José Miguel Burdio Pinilla, Saragossa (ES); Claudio Carretero Chamarro, Saragossa (ES); Jose Maria De la Cuerda Ortin, Saragossa (ES); Jose-Ramon Garcia Jimenez, Saragossa (ES); Pablo Jesus Hernandez Blasco, Cuarte de Huerva (ES); Oscar Jimenez Navascues, Cintruénigo (ES); Sergio Llorente Gil, Saragossa (ES); Oscar Lucia Gil, Saragossa (ES); Arturo Mediano Heredia, Saragossa (ES); Ignacio Millan Serrano, Saragossa (ES); Fernando Monterde Aznar, Saragossa (ES); Daniel Moros Sanz, Saragossa (ES); Denis Navarro Tabernero, Zuera (ES); Jose Joaquin Paricio Azcona, Saragossa (ES); Diego Puyal Puente, Saragossa (ES); Isidro Urriza Parroque, Saragossa (ES)

(73) Assignee: BSH Hausgeräte GmbH, Munich (DE)

( * ) Notice: Subject to any disclaimer, the term of this patent is extended or adjusted under 35 U.S.C. 154(b) by 45 days.

(21) Appl. No.: 13/503,384

(22) PCT Filed: Oct. 19, 2010

(86) PCT No.: PCT/IB2010/054723

§ 371 (c)(1),
(2), (4) Date: Apr. 23, 2012

(87) PCT Pub. No.: WO2011/051856

PCT Pub. Date: May 5, 2011

(65) Prior Publication Data

US 2012/0205365 A1 Aug. 16, 2012

(30) Foreign Application Priority Data

Oct. 26, 2009 (ES) ..... ES200930899

(51) Int. Cl.
*H05B 6/06* (2006.01)

(52) U.S. Cl.
CPC ..... *H05B 6/065* (2013.01)

(58) Field of Classification Search
CPC ..... H05B 6/04; H05B 6/101; H05B 6/02
(Continued)

(56) References Cited

U.S. PATENT DOCUMENTS 3,806,688 A * 4/1974 MacKenzie ..... H05B 6/062 219/625
3,989,916 A * 11/1976 Amagami ..... H02M 7/523 219/622

(Continued)

FOREIGN PATENT DOCUMENTS

EP 0971562 A1 1/2000
EP 0986287 A2 3/2000

(Continued)

OTHER PUBLICATIONS

Machine Translation EP2306784; Apr. 3, 2014.*

(Continued)

*Primary Examiner* — Tu B Hoang
*Assistant Examiner* — Thomas J Ward
(74) *Attorney, Agent, or Firm* — Michael E. Tschupp; Andre Pallapies; Brandon G. Braun

(57) ABSTRACT

A cook top with at least two heating elements includes a power electronics arrangement connected to a domestic (Continued)

single phase AC supply. The power electronics arrangement includes several power supply units, which each supply heating currents to one or more heating elements, and a switch arrangement with several electromechanical relays for connecting/disconnecting the power supply units to/from the heating elements. Output poles of at least two electromechanical relays associated with different power supply units are connected in parallel, wherein the parallel connection is permanently connected to at least one of the heating elements. This arrangement reduces the number of switching processes required for alternating use of a power supply device with several heating elements, and simplifies compliance with electromagnetic compatibility standards.

24 Claims, 2 Drawing Sheets

(58) Field of Classification Search
USPC ..... 219/620, 507
See application file for complete search history.

(56) References Cited

U.S. PATENT DOCUMENTS 4,482,800 A * 11/1984 Schweig ..... H05B 3/68 219/448.11
4,493,979 A * 1/1985 Bredel ..... H05B 3/68 219/445.1
6,018,154 A * 1/2000 Izaki ..... H02M 7/537 219/625
6,498,325 B1 * 12/2002 Akel ..... H05B 6/065 219/624
7,504,604 B2 3/2009 Barragan Perez et al.
2009/0139980 A1 6/2009 Acero Acero et al.
2009/0230123 A1 * 9/2009 Egenter ..... H05B 6/04 219/660
2010/0206867 A1 8/2010 Acero Acero et al.
2010/0258556 A1 * 10/2010 Hayashi ..... H05B 6/065 219/661
2011/0079591 A1 * 4/2011 Parachini ..... H05B 6/065 219/620
2011/0147366 A1 * 6/2011 Franca ..... H05B 1/0266 219/443.1

FOREIGN PATENT DOCUMENTS

EP 1931177 A1 6/2008
JP 2009-158366 A * 7/2009
WO WO2007048700 * 3/2007 ..... H05B 6/04

OTHER PUBLICATIONS

Machine Translation of WO2007048700 (Year: 2019).*
International Search Report PCT/IB2010/054723.
Report of Examination including Search Report CN201080048456.5 dated Jun. 27, 2013.
Report of Examination EP 10 776 822.8 dated Dec. 20, 2013.

* cited by examiner

COOK TOP COMPRISING AT LEAST TWO HEATING ELEMENTS AND A POWER ELECTRONICS ARRANGEMENT

BACKGROUND OF THE INVENTION

The invention relates to a cook top comprising at least two heating elements and a power electronics arrangement as claimed by the invention.

EP 0 986 287 B1 and EP 0 971 562 B1 disclose cook tops having a plurality of heating elements and a power electronics arrangement for connecting the cook top to one or more phases of a domestic AC supply. It is normal to use separate power electronics arrangements, each with a filter and a rectifier, for each phase of a domestic AC supply. Cook tops which are only connected to one phase of the domestic AC supply are generally of inexpensive and simple design and, because of the power limitation of the domestic AC supply, typically have a limited heat output of max. 4.6 kW.

On the other hand, there is a trend toward equipping cook tops with a large number of heating elements which can be used flexibly and can be turned on or off depending on the size and/or position of a cooking utensil placed on the cook top. In such cook tops, power supply units that can be operated independently of one another are installed which are used at any one time to heat a cooking utensil and can be flexibly connected via a switch arrangement to the heating elements assigned to the respective cooking utensil. To implement such switch arrangements, it is known to use electromechanical relays which can make or break a connection between the power supply units and the heating elements.

Switch arrangements of this kind generally interconnect a large number of heating elements, e.g. small inductors of a matrix cook top, to a much smaller number of power supply units, e.g. inverters. The switch arrangement therefore branches out in the direction of the heating elements and, as a rule, each heating element is assigned to the end of a limb of the branching tree structure. Each of the heating elements can therefore be connected to a power supply unit in just one way. Exceptions to this rule can be found in cook tops having what is known as booster mode in which two power supply units can be interconnected to operate a single heating element. A corresponding electromechanical relay opens or closes a link between the two power supply units, in particular between two inverters of an induction cook top. As the heating power in booster mode is to be concentrated onto just one heating element, an additional switch which can disconnect from the power supply the heating elements that are not to be heated is disposed between this switched link and the heating elements in each case.

In order to open up potential cost savings, it is important to be able to use the available resources flexibly for different heating elements. It should be noted here that, in the case of a cook top with a large number of heating elements, it is unlikely that all the heating elements will be used simultaneously and that even if all the heating zones or heating elements are in use, it is only in the rarest of cases that each of the heating elements will need to be operated at full power.

BRIEF SUMMARY OF THE INVENTION

The object of the invention is therefore to make the assignment between power supply units and heating elements more flexible, to reduce the number of switching operations necessary for the alternating use of a power supply unit for a plurality of heating elements, and to facilitate compliance with electromagnetic compatibility standards. The object of the invention is also to allow emergency operation of the cook top even if one of the switches in the switch arrangement becomes inoperable as the result of a defect.

This object is achieved in particular by a cook top having the features and embodiments of the invention will emerge from the sub claims.

The invention relates in particular to a cook top comprising at least two heating elements and a power electronics arrangement for connection to a phase of a domestic AC supply. The power electronics arrangement comprises a plurality of power supply units each supplying one or more heating elements with heating current. The cook top additionally comprises a switch arrangement with a plurality of electromechanical relays for connecting and/or disconnecting the power supply units to/from the heating elements.

The invention relates in particular to cook tops having at least three heating zones i.e. at least three heating elements which are supplied from a single phase of the domestic AC supply and which are disposed, for example, under a cover plate measuring 60 by 80 cm.

It is proposed that at least one of the heating elements is permanently connected to one of at least two output poles of at least two of the electromechanical relays in each case. As a result, a redundant switch arrangement is implemented in which the heating element can be optionally supplied with heating current via two different paths, each of the paths comprising one of the two relays. The number of switching options and the number of possible assignments between power supply units and heating elements is considerably increased, thereby increasing the flexibility of the cook top.

Because of the short response times of induction cook tops compared to radiant cook tops, induction cook tops are particularly suitable for time division multiplex operation. The advantages of the invention are therefore particularly applicable to induction cook tops. In this case, the heating elements are inductors and the power supply units comprise an inverter which can generate a high-frequency heating current from the rectified and possibly filtered current from the domestic AC supply. The frequencies of heating currents in induction cook tops are typically between 20 and 100 kHz.

As the distribution of the available energy to the heating elements or heating zones can be simplified by the invention, a satisfactory result can also be achieved using a lower nominal output of the power electronics arrangement. In particular, the sum of the nominal outputs of the heating elements can be selected greater than the nominal output of the power electronics arrangement. The nominal output of the power electronics arrangement is generally just below the maximum available power of a phase of the domestic AC supply and can be, for example, 4.6 kW for Germany. The maximum power drawn by the power electronics can also be made settable as a function of the available power. This setting can also be performed in combination with other national settings, e.g. a time zone and/or language.

It is further proposed that in the unenergized i.e. normally closed (NC) state of the two relays just one of the two relays connects the heating element to one of the power supply units, while the other relay opens the connection to the same power supply unit or another power supply unit. As a result, operation of the heating element can be implemented even if the switching currents are unavailable because of a defect.

It is additionally proposed that one of the heating elements is permanently connected to one of at least two output poles of at least two of the electromechanical relays. The redundant power supply can therefore be implemented for each of the heating elements. Alternatively, one or more heating elements can be connected to one of at least two output poles of only a single electromagnetic relay.

Potential cost savings can be achieved by sharing of hardware if the power electronics arrangement comprises a common low-pass filter and rectifier for all the power supply units.

In particular, single-pole double-throw switches can be used as electromechanical relays, wherein the two output poles can be connected to different heating elements. In this case it is further proposed that a common center terminal of the relay is connected to a power supply unit and the two output poles of the relay to a heating element in each case, i.e. are disposed between the heating element and the power supply unit in the corresponding direction.

Further increased flexibility of the switch arrangement can be implemented by a plurality of series-connected relays in a connection between a power supply unit and a heating element. The switch arrangement can in particular comprise a plurality of branching layers.

The number of branching layers, i.e. the number of relays connected in series, can also be made different for different heating elements. For example, it may be advisable to configure the switch arrangement such that centrally disposed heating elements can be connected to a particularly large number of power supply units i.e. inverters, while heating elements disposed at the edge of the cook top can be connected to a smaller number of power supply units. This enables the centrally disposed heating elements to be very flexibly combined with other heating elements to form heating zones, which is not required to the same extent for heating elements disposed at the edge of the heating zone.

BRIEF DESCRIPTION OF THE DRAWINGS

Further advantages will emerge from the following description of the drawings which depict exemplary embodiments of the invention. The drawings, the description and the claims contain numerous features in combination. The average person skilled in the art will also expediently consider the features individually and integrate them to produce further useful combinations.

DETAILED DESCRIPTION OF EXEMPLARY EMBODIMENTS OF THE PRESENT INVENTION

Figure 1:
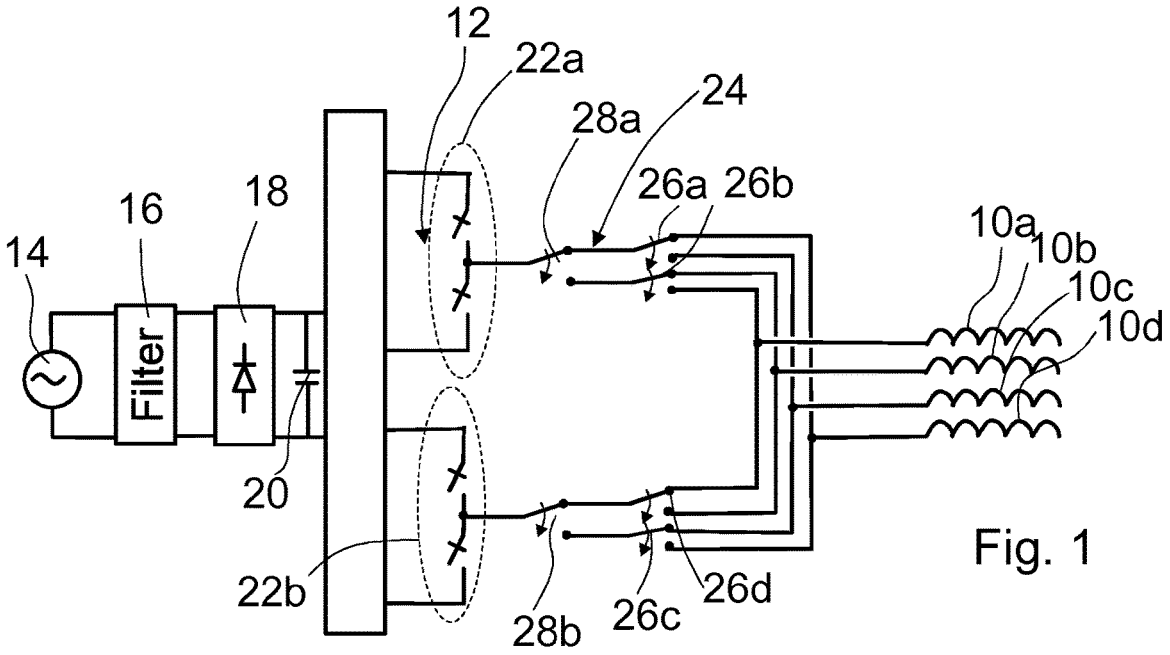
FIG. 1 schematically illustrates the design of a cook top having a plurality of heating elements and a power electronics arrangement for connection to an individual phase of a domestic AC supply, FIG. 2 schematically illustrates the design of a cook top according to an alternative embodiment of the invention, FIG. 3 schematically illustrates the design of a cook top according to an another alternative embodiment of the invention, and FIG. 4 schematically illustrates the design of a cook top in a generalization of the inventive concept.

FIG. 1 schematically illustrates a cook top comprising four heating elements 10*a*-10*d* and a power electronics arrangement 12. The power electronics arrangement is used to connect the cook top to a single phase 14 of a domestic AC supply and powers the entire cook top from the current of said phase 14.

The power electronics arrangement comprises a filter 16 and a rectifier 18 which filter the alternating current from the domestic supply and convert it into direct current which undergoes further filtering by a damping capacitor 20. The filter 16 is a low-pass filter which prevents cook top damage caused by powerful pulses from the domestic AC supply as well as flicker-intensifying feedback from the cook top into the AC supply.

In the example shown in FIG. 1, the power electronics module additionally comprises two power supply units 22*a*,22*b* which are implemented as inverters and are operated by a control unit (not shown here) such that a heating current with a desired heating frequency is produced. The two inverters 22*a*,22*b* can generate heating currents with different heating frequencies, different amplitudes and/or different load cycles or rather phases in order to produce the desired heating power in the heating elements 10*a*-10*d*. The heating elements 10*a*-10*d* are inductors which generate a high-frequency magnetic field at the frequency of the heating current. The magnetic field induces eddy currents in a ferromagnetic base of a cooking vessel placed on the cook top in the region of the heating element 10*a*-10*d* in question, thereby directly heating said vessel.

Disposed between the power supply units 22*a*,22*b* and the heating elements 10*a*-10*d* is a switch arrangement 24 comprising electromechanical relays 26*a*-26*d*. The relays 26*a*-26*d* are single-pole double-throw switches whose common central terminal is connected to a pole of two other relays 28*a*,28*b* in each case. The other relays 28*a*, 28*b* are each connected via their central terminal to a power supply unit 22*a*, 22*b*. By appropriate switching of the relays 26*a*,26*b*, 28*a*-28*d*, each of the power supply units 22*a*, 22*b* can be connected to each of the heating elements 10*a*-10*d*. The heating elements 10*a*-10*d* are in turn permanently connected in each case to two output poles of two different relays 26*a*-26*d* of the second layer of relays of the switch arrangement 24. As a result, each of the heating elements 10*a*-10*d* can be simultaneously connected to both power supply units 22*a*,22*b* in order to concentrate the total available energy on the heating element 10*a*-10*d* in question. In this case, the two power supply units 22*a*,22*b* implemented as inverters must generate heating currents of the same heating frequency in order to prevent destructive interference.

The output poles of the relays 26*a*-26*d* to which one of the heating elements 10*a*-10*d* is connected are selected such that, in the unenergized state of the relays 26*a*-26*d* just one of the relays connects the heating element 10*a*-10*d* to one of the power supply units 22*a*,22*b*, while the other relay 26*a*-26*d* breaks the connection to the other power supply unit 22*a*,22*b*. The heating element 10*a* is therefore, for example, connected to the normally closed (NC) output pole of the relay 26*b* and to the normally open (NO) output pole of the relay 26*c*.

The sum of the nominal outputs of the heating elements 10*a*-10*d* is greater than the nominal output of the power electronics arrangement 12, i.e. of the phase 14 of the domestic AC supply. For example, the sum of the nominal outputs of the heating elements 10*a*-10*d* can be 7.2 kW and the nominal output of the power electronics arrangement 4.6 kW.

By means of the two-layer design of the switch arrangement 24 shown in FIG. 1, two series connected relays 28*a*,28*b*,26*a*-26*d* are disposed in the connections between the heating elements 10*a*-10*d* and the power supply units 22*a*,22*b* in each case.

Figure 2:
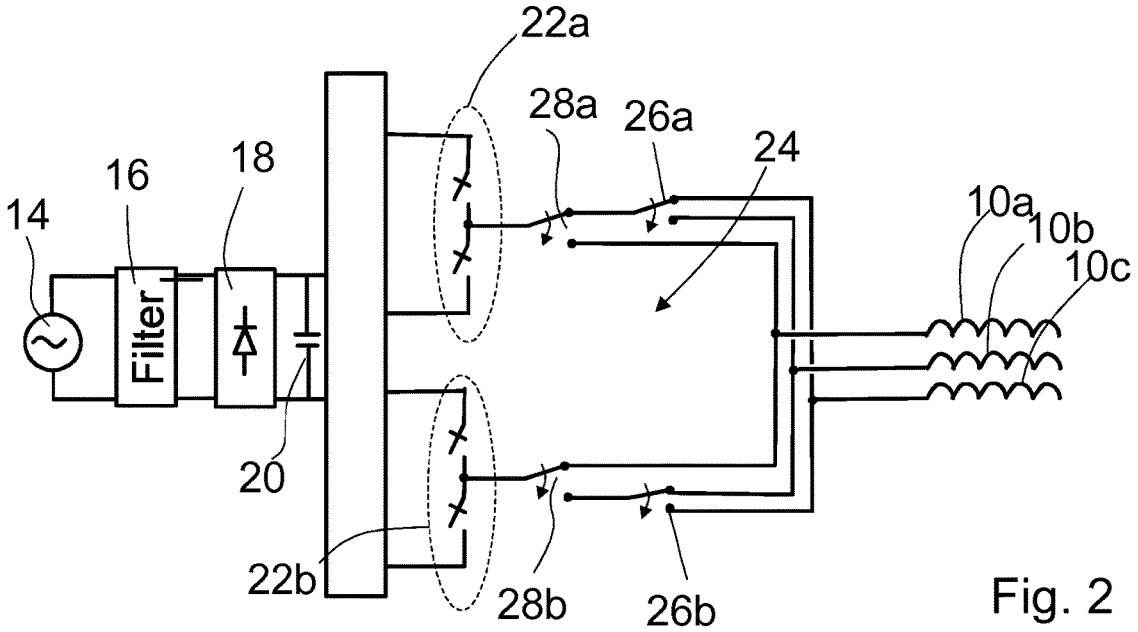

FIG. 2 shows another exemplary embodiment of the invention. In order to avoid repetitions, the following description will essentially confine itself to differences compared to the exemplary embodiment shown in FIG. 1, reference being made to FIG. 1 in respect of features that remain unchanged.

In the exemplary embodiment shown in FIG. 2, the cook top comprises three heating elements 10*a*-10*c* and the switch arrangement 24 comprises only four relays 28*a*,28*b*,26*a*,26*b* in total. The heating element 10*a* is only connected to the power supply units 22*a*,22*b* via one relay 28*a*,28*b* in each case, while the heating elements 10*b*, 10*c* are each connected to the power supply units 22*a*,22*b* via two series connected relays 26*a*, 28*a* and 26*b*, 28*b* respectively.

Figure 3:
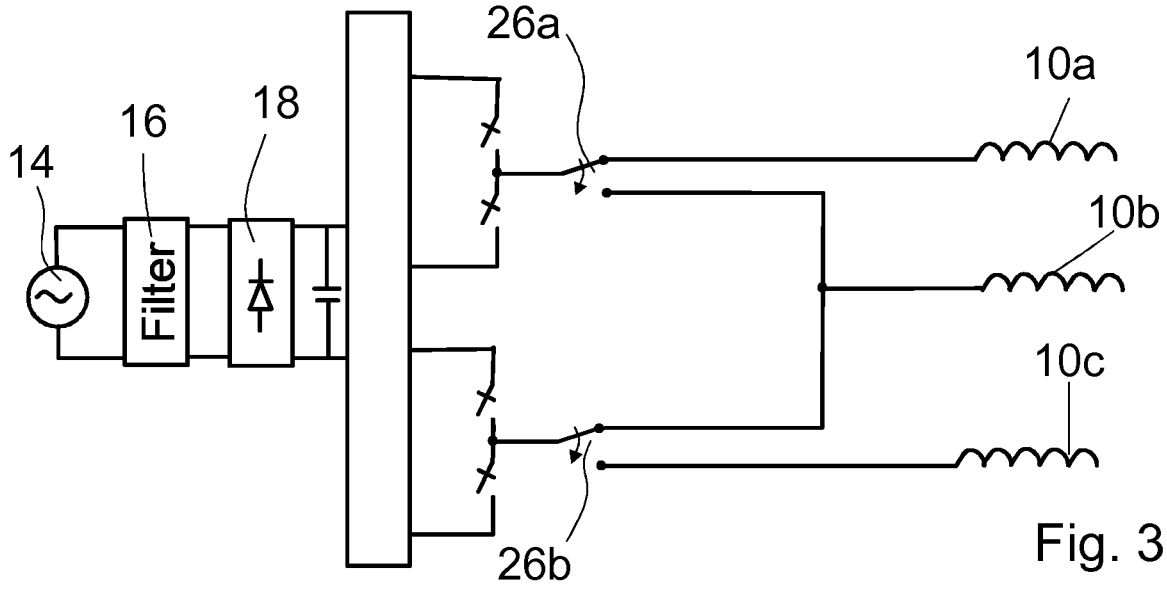

FIG. 3 shows another alternative exemplary embodiment of the invention comprising only two relays 26*a*, 26*b* and three heating elements 10*a*, 10*b*, 10*c*. Of the heating elements, only the middle heating element 10*b* is connected to output poles of the two relays 26*a*,26*b*, while the heating elements 10*a* are connected to the output pole of only one relay 26*a*,26*b* in each case.

Figure 4:
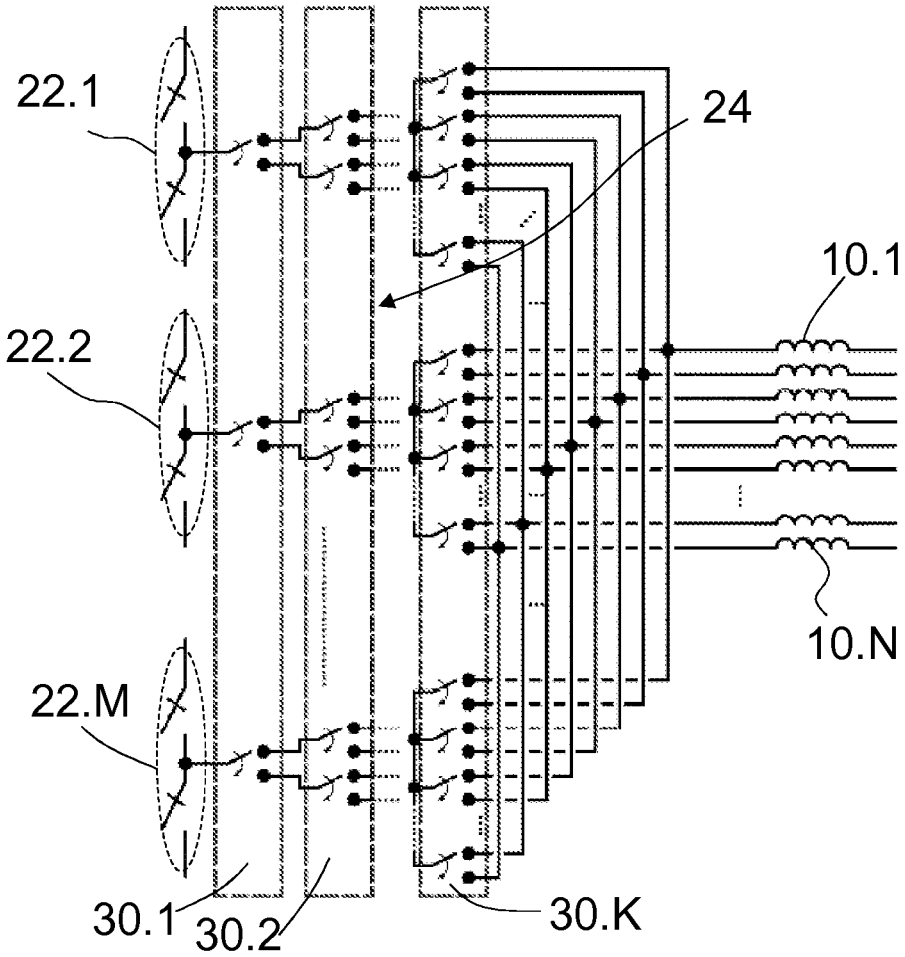

FIG. 4 shows a generalization of the design of an inventive induction cook top having M power supply units 22.1-22.M, or more specifically inverters, and N heating elements 10.1-10.N which are connected to the power supply units 22.1-22.M via a switch arrangement 24, where M<N. The number K of branching layers 30.1-30.K of the arrangement 24 is at least as great as the largest integer which is greater than the binary logarithm from the number of power supply units M.

The switch arrangement 24 can be mounted on a separate circuit board or together with the power supply units 22.1-22.M on a single circuit board. The same applies to the low-pass filter 16 and the rectifier 18. These elements can also be mounted on a separate circuit board or together with the power supply units 22.1-22.M on a large circuit board.

The invention can be used both for traditional layouts with four permanently predefined heating zones and for matrix cook tops with a large number of heating elements which are disposed in a grid and can be flexibly combined for heating a single cooking vessel. The topology in FIG. 3 is particularly suitable for layouts with so-called paella heating zones in which a large heating zone for heating a paella pan can be produced in the middle of the cook top using the central heating element 10*b*.

REFERENCE CHARACTERS

10 heating element
12 power electronics arrangement
14 phase
16 filter
18 rectifier
20 damping capacitor
22 power supply unit
24 switch arrangement
26 relay
28 relay
30 branching layer

The invention claimed is:

1. A cook top, comprising:

a plurality of heating elements including a first and a second heating element, wherein each of the heating elements is continuous and defines a respective pair of electrical input terminals;

a power electronics arrangement having an input connected to a single phase of a domestic AC supply, said power electronics arrangement comprising a plurality of power supply units, each power supply unit supplying one or more of the heating elements with heating currents; and a switch arrangement comprising a plurality of electromechanical relays comprising a first group of the plurality of electromechanical relays operable to connect a first power supply unit of the plurality of power supply units to the first heating element and the second heating element, and a second group of the plurality of electromechanical relays operable to connect a second power supply unit of the plurality of power supply units to the first heating element and the second heating element, the plurality of electromechanical relays further operable to:

(a) selectively electrically connect the electrical input terminals of each of the heating elements to either the first power supply unit or the second power supply unit, such that one of the first group and the second group is in an open configuration and the other of the first group and the second group is in a closed configuration;

(b) electrically disconnect the electrical input terminals of each of the heating elements from both the first power supply unit and the second power supply unit, such that both of the first group and the second group are in the open configuration; and (c) selectively electrically connect the electrical input terminals of the first heating element simultaneously to two power supply units of the plurality of power supply units, such that both of the first group and the second group are in the closed configuration and the first heating element is powered by the two power supply units;

wherein the first and second heating elements are permanently connected in parallel to outputs of at least two of the electromechanical relays; and wherein the at least two of the electromechanical relays are each associated with a different one of the power supply units.

2. The cook top of claim 1, wherein the plurality of heating elements are inductors and each of the plurality of power supply units comprises an inverter.

3. The cook top of claim 1, wherein a sum of nominal power output of the plurality of heating elements is greater than a nominal power output of the power electronics arrangement.

4. The cook top of claim 1, wherein in an unenergized state of the plurality of electromechanical relays, exactly one of the plurality of electromechanical relays connects one of the plurality of heating elements to one of the plurality of power supply units, while others of the plurality of relays disconnect the one of the plurality of heating elements from other power supply units of the plurality of power supply units.

5. The cook top of claim 1, wherein output poles of at least two of the plurality of electromechanical relays are connected in parallel, and wherein each of the plurality of heating elements is permanently connected to the parallel-connected output poles.

6. The cook top of claim 1, wherein at least one of the plurality of heating elements is connected to one of at least two output poles of a single electromechanical relay of the plurality of electromechanical relays.

7. The cook top of claim 1, wherein the power electronics arrangement comprises a low-pass filter and a rectifier which are shared by all of the plurality of power supply units.

8. The cook top of claim 1, wherein at least two of the plurality of electromechanical relays are single-pole double-throw switches.

9. The cook top of claim 8, wherein a single-pole double-throw switch has a common central terminal connected to one of the plurality of power supply units and two output poles, with each output pole connected to a different one of the plurality of heating elements.

10. The cook top of claim 1, wherein the switch arrangement comprises a plurality of series-connected relays, with the series connection connected between one of the plurality of power supply units and one of the plurality of heating elements.

11. The cook top of claim 10, wherein a number of series-connected relays disposed between at least one first heating element and a power supply unit is different from a number of series-connected relays disposed between at least one second heating element and a power supply unit.

12. A cook top, comprising:

a plurality of heating elements including a first and a second heating element, wherein each of the heating elements is continuous and defines a respective pair of electrical input terminals;

a power electronics arrangement having an input connected to a single phase of a domestic AC supply, said power electronics arrangement comprising a plurality of power supply units, each power supply unit supplying one or more of the heating elements with heating currents; and a plurality of switches comprising a first group of the plurality of switches operable to connect a first power supply unit of the plurality of power supply units to the first heating element and the second heating element, and a second group of the plurality of switches operable to connect a second power supply unit of the plurality of power supply units to the first heating element and the second heating element, the plurality of switches further operable to:

(a) selectively electrically connect the electrical input terminals of each of the heating elements to either the first power supply unit or the second power supply unit, such that one of the first group and the second group is in an open configuration and the other of the first group and the second group is in a closed configuration, (b) electrically disconnect the electrical input terminals of each of the heating elements from both the first power supply unit and the second power supply unit, such that both of the first group and the second group are in the open configuration, and (c) selectively electrically connect the electrical input terminals of the first heating element simultaneously to two power supply units of the plurality of power supply units, such that both of the first group and the second group are in the closed configuration and the first heating element is powered by the two power supply units, wherein the first and the second heating elements are permanently connected in parallel to-outputs of at least two of the switches; and wherein the at least two of the switches are each associated with a different one of the power supply units.

13. The cook top of claim 12, wherein the plurality of heating elements are inductors and each of the plurality of power supply units comprises an inverter.

14. The cook top of claim 12, wherein a sum of nominal power output of the plurality of heating elements is greater than a nominal power output of the power electronics arrangement.

15. The cook top of claim 12, wherein in a first state of the plurality of switches, exactly one of the plurality of switches connects one of the plurality of heating element to one of the plurality of power supply units, while others of the plurality of switches disconnect the heating element from other power supply units.

16. The cook top of claim 12, wherein output poles of at least two of the plurality of switches are connected in parallel, and wherein each of the plurality of heating elements is permanently connected to the parallel-connected output poles.

17. The cook top of claim 12, wherein at least one of the plurality of heating elements is connected to one of at least two output poles of a single switch.

18. The cook top of claim 12, wherein the power electronics arrangement comprises a low-pass filter and a rectifier which are shared by all of the plurality of power supply units.

19. The cook top of claim 12, wherein the plurality of switches are single-pole double-throw switches.

20. The cook top of claim 19, wherein a single-pole double-throw switch has a common central terminal connected to one of the plurality of power supply units and two output poles, with each output pole connected to a different one of the plurality of heating elements.

21. The cook top of claim 12, wherein the plurality of switches comprises a plurality of series-connected switches, with the series connection connected between one of the plurality of power supply units and one of the plurality of heating elements.

22. The cook top of claim 21, wherein a number of series-connected switches disposed between at least one first heating element and one of the plurality of power supply units is different from a number of series-connected switches disposed between at least one second heating element and one of the plurality of power supply units.

23. The cook top of claim 1, wherein the plurality of electromechanical relays are controlled by the cook top.

24. The cook top of claim 12, wherein the plurality of switches is controlled by the cooktop.

* * * * *